United States Patent [19]

Gardner et al.

[11] Patent Number: 4,702,232

[45] Date of Patent: Oct. 27, 1987

[54] METHOD AND APPARATUS FOR INDUCING VENOUS-RETURN FLOW

[75] Inventors: Arthur M. N. Gardner; Roger H. Fox, both of Devon, England

[73] Assignee: Electro-Biology, Inc., Parsippany, N.J.

[21] Appl. No.: 787,124

[22] Filed: Oct. 15, 1985

[51] Int. Cl.[4] ..... A61H 7/00

[52] U.S. Cl. ..... 128/64

[58] Field of Search ..... 128/64, 24 R, 25 R, 128/25 B, 28–30.2, 38–40, DIG. 20

[56] References Cited

U.S. PATENT DOCUMENTS

| | | | |
|---|---|---|---|
| 3,811,431 | 5/1974 | Apstein | 128/64 |
| 3,888,242 | 6/1975 | Harres et al. | 128/64 |
| 4,374,518 | 2/1983 | Villanueva | 128/64 |

FOREIGN PATENT DOCUMENTS

| | | | |
|---|---|---|---|
| 2390156 | 1/1979 | France | 128/24 R |

*Primary Examiner*—Richard J. Apley
*Assistant Examiner*—J. Welsh
*Attorney, Agent, or Firm*—Hopgood, Calimafde, Kalil, Blaustein & Judlowe

[57] ABSTRACT

Venous blood flow in a non-ambulating human leg is involuntarily promoted in a repeating cycle of successively actuated venous pumps, in imitation of the pump-actuating sequence which characterizes normal walking. Specifically, in the preferred embodiment, the proximal calf pump and the distal calf pump are operated, in that sequential order, following a given operation of the foot pump and prior to the next successive operation of the foot pump.

10 Claims, 2 Drawing Figures

METHOD AND APPARATUS FOR INDUCING VENOUS-RETURN FLOW

BACKGROUND OF THE INVENTION

The invention relates to the artificially induced flow of venous blood in a human leg which, for one reason or another, may be impaired, in that normal processes associated with normal walking are either inadequate or not available to the patient.

In our pending patent applications, Ser. Nos. 621,499 and 763,686 (said applications being herein incorporated by reference), we disclose inflatable bladder or cuff means for promoting return flow of venous blood, by pulsed compression of the blood vessels within the plantar arch, the same being accomplished by transient flattening the plantar arch and/or by transient upward application of squeezing force against the sole of the foot. In either case, the action is localized between the ball and the heel of the foot. In the case of flattening the plantar arch, spreading force is directed at and between the ball and heel of the foot; in the other case, the sole of the foot is squeezed upward against the underside of reacting metatarsal and tarsal bone structure.

In normal walking, the foot is intermittently weight-bearing, as a result of which the involved plantar arch is transiently flattened and foot-pump action proceeds, with little or no muscular intervention. The devices and methods of said patent applications are operative to produce foot-pump action in non-weight-bearing circumstances, as when the patient is bedridden or the leg is in a cast.

Effective as our foot-pump actuating method and bladder devices may be, the fact remains that such actuation of the foot pump alone will not fully duplicate the pumping cycle which is the result of normal walking, for the reason that, although the foot pump is the primary pump in the leg, there are two further pumps which importantly contribute in each cycle of normal walking. These two further pumps are in the calf and unlike the foot pump, are normally muscle-actuated. More specifically, in walking forward, and after weight has been borne on the sole of the foot, the muscles in the upper part of the calf contract to plantarflex the ankle; and, in contracting, these muscles squeeze and empty affected veins, thus operating the proximal venous calf pump. Subsequently, as the leg is swung forward to take another step, the ankle is dorsiflexed to prevent the toes from dragging on the ground, and this action empties the distal calf pump. And finally, as weight is borne once more on the sole of the foot, the venous calf pumps are again primed.

BRIEF STATEMENT OF THE INVENTION

It is an object of the invention to provide an improved method and means of promoting and/or enhancing venous-blood flow in a human leg.

A specific object is to achieve the above object by involuntarily activating a foot pump in such sequential relation with one or more venous pumps of the same limb as to imitate the cyclical succession of venous pump action which would occur in normal walking.

It is also an object to achieve the foregoing objects with relatively simple and inexpensive procedure and apparatus.

The invention achieves the foregoing objects by activating the foot pump in the manner of said pending patent applications and by further activating one or more venous pumps of the same leg, such actuations being in the sequential relation which also applies for the case of normal walking in the forward direction.

DETAILED DESCRIPTION

Figures 1, 2:
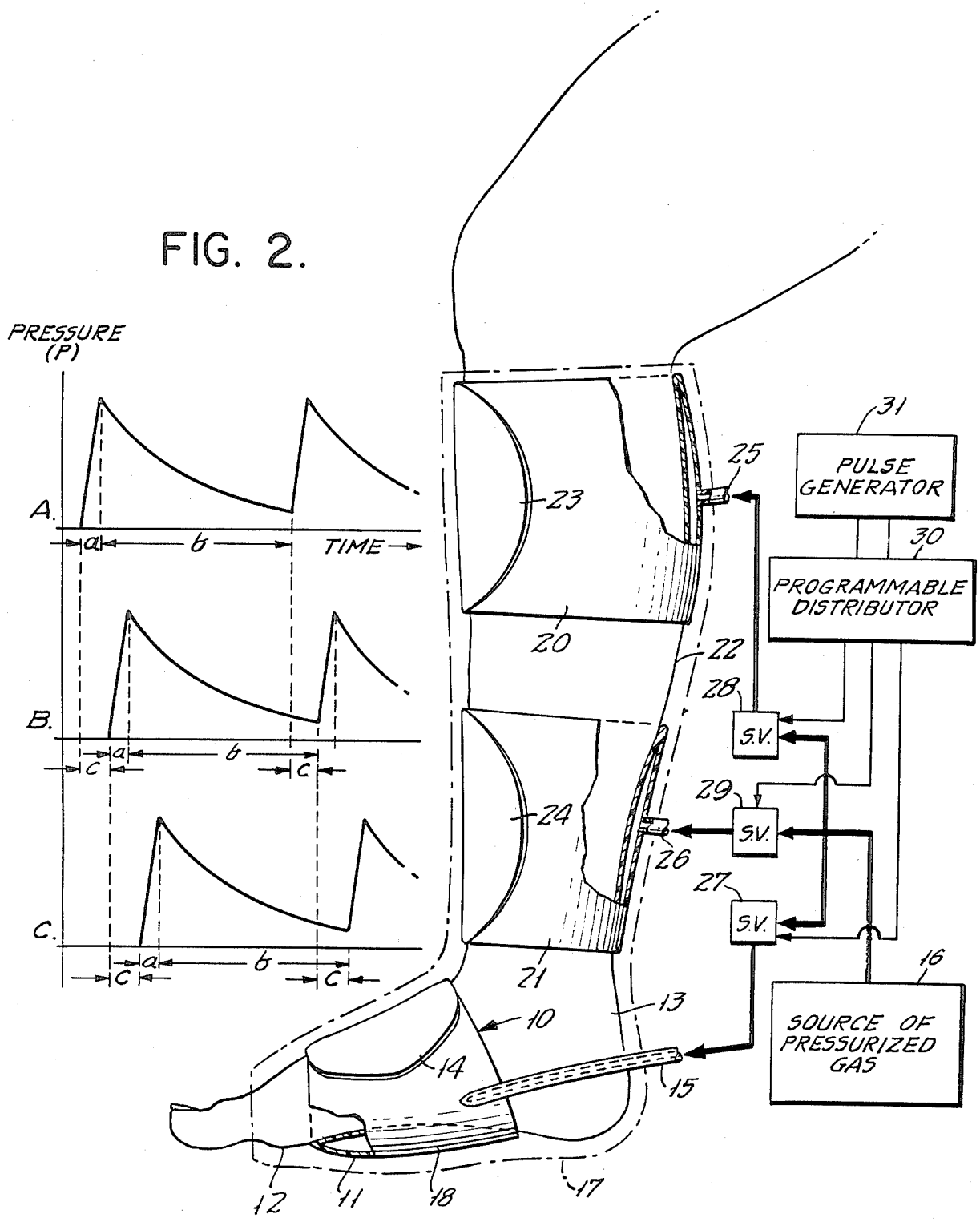

A presently preferred embodiment of the invention will be described in detail, in conjunction with the accompanying drawings, in which:

FIG. 1 is a simplified view in side elevation of the calf and foot extremity of a leg to which apparatus of the invention has been applied; and FIG. 2 is a succession of pressure profiles to the same time scale to illustrate the phased relation of different pump actuations in a cycle of operation of the invention.

In FIG. 1, a foot-pump actuator 10 includes an inflatable bag 11 formed of plastics material and shaped for engagement with the sole 12 of a human foot 13 in the plantar arch thereof. Bag structures of this kind are described in greater detail in said pending patent applications and therefore elaboration is not now needed. It suffices to state that in a preferred embodiment one or both of the panels which define the bag 11 are perforated for the venting of pressure fluid (e.g., compressed air or oxygen) used to periodically inflate the bag. The bag 11 (of appropriate size) is longitudinally limited by and between the ball and heel of the foot and may circumferentially envelope all or a part of the mid-tarsal region of the foot; it may thus form part of a shaped cuff having a retaining tab end 14 which removably laps and is adhered to an upper part of the bag, as shown. A flexible pipe 15 connects the bag to fluid-pressure supply means, to be later described but shown to include a source 16 of pressurized gas.

As described in said pending applications, the inflatable actuator 10 may be contained within an orthopedic cast, in which case the phantom outline 17 will be understood to identify the same. Alternatively, the panel 18 of flexible material which is the outer half of the bag may be stoutly resistive to stretch, whereby bag-inflation pressures are assuredly inward, against at least the plantar region of the sole 12, being operative to spread apart the ball and heel, thus to a degree flattening the plantar arch.

In accordance with the invention, further pump actuators 20–21 are also fitted to the respective upper and lower regions of the calf, for transient squeezing actuation of the proximal and distal venous-pump regions of the calf 22. Each of the actuators 20–21 may be an inflatable cuff, held in place by a circumferential wrap of the calf, and removably secured by tab means 23–24 in the manner described for tab 14. Flexible pipes 25–26 receive pressure fluid for inflation. Again, at least one of the panels of each inflatable cuff may be perforated, and the outer panel in each case is preferably stoutly resistive to stretch. Each of the calf cuffs 20–21 may be as wide as 10 centimeters.

The means shown for connection of all inflatable cuffs to the pressure source 16 is a solenoid valve, there being one such valve 27, 28, 29 for each of the respective supply lines 15, 25, 26; and all valves 27, 28, 29 have common connection to source 16. Valves 27, 28, 29 are controlled in sequence by separate electrical pulse signals issuing from the respective outputs of a programmable distributor 30, coacting with a pulse generator 31. The sequence of pulsed actuation of the solenoid valves is in a recurrent cycle wherein valve 27 activates the foot-pump cuff 10, then valve 28 actuates the proximal cuff 20, and valve 29 thereafter actuates the distal cuff 21.

The relative timing of cuff inflations will be better appreciated from discussion in connection with FIG. 2, wherein curve A is the profile of inflation pressure at the foot-pump cuff, curve B is the profile of inflation pressure at the proximal venous calf pump 20 and curve C is the profile of inflation pressure at the distal venous calf pump 21. Pressure profiles are in every case closely alike being supplied by a common source affected essentially only by the phase-delaying action of the distributor 30. Preferably each profile comprises a steep rise of short duration a, in the order of less than one second, at which point the applicable solenoid valve closes to allow relatively slow pressure drop off, via perforation leakage or active deflation; at lapse of a longer interval b, which is in the range 10 to 60 seconds, the cycle repeats for each cuff. The maximum (or peak) inflation pressure may be as much as 220-mm Hg.

The time delay c between foot-pump actuation (curve A) and proximal calf pump actuation (curve B) may be up to fifteen seconds and is preferably about three or four seconds. This same time delay c also applies between proximal calf pump actuation and distal calf pump actuation (curve C). On the other hand, the interval between distal calf pump actuation and foot-pump actuation (curve A) should not curtail the interval b which will be understood to allow foot-pump priming between successive foot-pump actuations.

The described apparatus and the mode of its operation will be seen to meet all stated objects. The volumetric inflatable capacity of all cuffs may be substantially the same, and the inflation pressure profile of all cuffs may be substantially the same, thus simplifying the apparatus and administration of the method. The operation of calf pumps between foot-pump actuations means an emptying of some of the venous return system (e.g., of the distal calf pump) before actuation of the foot pump, thus naturally conditioning veins for the next foot-pump generated flow, and with greater physiological toleration by the patient.

Although the invention has been described in detail for a preferred embodiment, it will be understood that modification may be made without departing from the scope of the invention. For example, operation of the foot pump in alternation with one but not necessarily both calf pumps can produce therapeutically beneficial results, especially when a local disability of the patient may preclude pump action at one of the calf-pump sites. Still further, the invention may utilize other forms of pump actuator and is therefore not limited to the particular inflatable cuff means that has been shown and described. In all cases, use of the invention is particularly tolerable to the patient, and a swollen region of the leg can be relieved and reduced, with the probability of reduced chances of a thrombosis.

What is claimed is:

1. The method of promoting venous-blood flow in an impaired human leg, which method comprises repeating a cycle of specific sequential pump events wherein an artificially induced transient operation of the foot pump of the leg is followed by an artificially induced separate transient operation of the proximal calf pump of the leg and then by an artificially induced separate transient operation of the distal calf pump of the leg, the artificially induced transient operation of the foot pump comprising the steps of simultaneously applying (a) upward and spreading force at longitudinally spaced plantar regions of the sole of the foot, said regions being essentially limited by and between the ball and heel of the foot and (b) downward force at the region of the midtarsal joint, said forces being applied in a cyclical pattern of relatively rapid increase to a predetermined upper limit before relaxation for a period substantially exceeding the application time, whereby the arch of the foot is caused to flatten periodically and thus to stretch and neck down the internal local sectional area of the veins of the lateral plantar complex, with resulting foot-derived venous-pump action, whereby as a result of such sequencing of pump events, venous-blood flow is caused to substantially imitate that which would occur in a normal walking cycle wherein the weight-bearing phase is followed by plantarflexing of the ankle and then by dorsiflexing of the ankle.

2. The method of promoting venous-blood flow in an impaired human leg, which method comprises repeating a cycle of specific sequential pump events wherein an artificially induced transient operation of the foot pump of the leg is followed by an artificially induced separate transient operation of the proximal calf pump of the leg and then by an artificially induced separate transient operation of the distal calf pump of the leg, the artificially induced transient operation of the the foot pump comprising the steps of simultaneously applying vertically opposed squeezing forces between the plantar region of the sole of the foot and the region of the midtarsal joint, said forces being applied in a cyclical pattern of relatively rapid increase to a predetermined upper limit before relaxation for a period substantially exceeding the application time, thereby to stimulate the venous-pump mechanism of the foot, whereby as a result of such sequencing of pump events, venous-blood flow is caused to substantially imitate that which would occur in a normal walking cycle wherein the weight-bearing phase is followed by plantarflexing of the ankle and then by dorsiflexing of the ankle.

3. The method of promoting venous-blood flow in an impaired human leg, which method comprises repeating a cycle of specific sequential pump events wherein an artificially induced transient operation of the foot pump of the leg is followed by an artificially induced separate transient operation of at least one of the calf pumps of the leg, the artificially induced transient operation of the foot pump comprising the steps of simultaneously applying (a) upward and spreading force at longitudinally spaced plantar regions of the sole of the foot, said regions being essentially limited by and between the ball and heel of the foot and (b) downward force at the region of the midtarsal joint, said forces being applied in a cyclical pattern of relatively rapid increase to a predetermined upper limit before relaxation for a period substantially exceeding the application time, whereby the arch of the foot is caused to flatten periodically and thus to stretch and neck down the internal local sectional are of the veins of the lateral plantar complex, with resulting foot-derived venous-pump action, whereby as a result of such sequencing of pump events, venous-blood flow is caused to respond to the action of said pumps in a manner aproximating that which would occur in a normal walking cycle of the leg.

4. The method of promoting venous-blood flow in an impaired human leg, which method comprises repeating a cycle of specific sequential pump events wherein an artificially induced transient operation of the foot pump of the leg is followed by an artificially induced separate transient operation of the proximal calf pump of the leg and then by an artificially induced separate transient operation of the distal calf pump of the leg, the artificially induced transient operation of the foot pump comprising the steps of establishing a peripherally continuous confinement of the midtarsal and plantar regions of a foot, and shrinking the confinement in a cyclical pattern of relatively rapid short-duration shrink action followed by a relatively long-duration release from shrink action, whereby as a result of such sequencing of pump events, venous-blood flow is caused to substantially imitate that which would occur in a normal walking cycle wherein the weight-bearing phase is followed by plantarflexing of the ankle and then by dorsiflexing of the ankle.

5. The method of promoting venous-blood flow in an impaired human leg, which method comprises repeating a cycle of specific sequential pump events wherein an artificially induced transient operation of the foot pump of the leg is followed by an artificially induced separate transient operation of at least one of the calf pumps of the leg, the artificially induced transient operation of the foot pump comprising the steps of simultaneously applying vertically opposed squeezing forces between the plantar region of the sole of the foot and the region of the midtarsal joint, said forces being applied in a cyclical pattern of relatively rapid increase to a predetermined upper limit before relaxation for a period substantially exceeding the application time, thereby to stimulate the venous-pump mechanism of the foot, whereby as a result of such squencing of pump events, venous-blood flow is caused to respond to the action of said pumps in a manner approximating that which would occur in a normal walking cycle of the leg.

6. The method of promoting venous-blood flow in an impaired human leg, which method comprises repeating a cycle of specific sequential pump events wherein an artificially induced transient operation of the foot pump of the leg is followed by an artificially induced separate transient operation of at least one of the calf pumps of the leg, the artificially induced transient operation of the foot pump comprising the steps of establishing a peripherally continuous confinement of the midtarsal and plantar regions of a foot, and shrinking the confinement in a cyclical pattern of relatively rapid short-duration shrink action followed by a relatively long-duration release from shrink action, whereby as a result of such sequencing of pump events, venous-blood flow is caused to respond to the action of said pumps in a manner approximating that which would occur in a normal walking cycle of the leg.

7. The method of claim 1 or claim 2 or claim 7, in which an interval of one to fifteen seconds intervenes between operation of the foot pump and operation of the proximal calf pump, and between operation of the proximal calf pump and operation of the distal calf pump, and in which an interval of 10 to 50 seconds intervenes between operation of the distal calf pump and the next-succeeding operation of the foot pump.

8. The method of claim 3 or claim 5 or claim 6, in which an interval of one to fifteen seconds intervenes between operation of the foot pump and the next-succeeding operation of a calf pump, and in which an interval of 10 to 50 seconds intervenes after a calf-pump operation and the next-succeeding operation of the foot pump.

9. The method of claim 1 or claim 2 or claim 4, in which an interval of one to fifteen seconds intervenes between operation of the foot pump and operation of the proximal calf pump, and between operation of the proximal calf pump and operation of the distal calf pump, and in which an interval of 10 to 50 seconds intervenes between operation of the distal calf pump and the next-succeeding operation of the foot pump, and in which the first-mentioned interval is about three or four seconds.

10. The method of claim 1 or claim 2 or claim 4, in which an interval of one to fifteen seconds intervenes between operation of the foot pump and operation of the proximal calf pump, and between operation of the proximal calf pump and operation of the distal calf pump, and in which an interval of 10 to 50 seconds intervenes between operation of the distal calf pump and the next-succeeding operation of the foot pump, and in which the last-mentioned interval is 15 to 40 seconds.

* * * * *